US006341723B1

(12) United States Patent
Nakahara et al.

(10) Patent No.: US 6,341,723 B1
(45) Date of Patent: Jan. 29, 2002

(54) METHOD OF PRODUCING GOLF CLUB HEADS

(75) Inventors: Norihiko Nakahara; Shinji Yamamoto, both of Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/465,019

(22) Filed: Dec. 16, 1999

(30) Foreign Application Priority Data

Dec. 17, 1998 (JP) ..... 10-358515

(51) Int. Cl.[7] ..... B23K 31/02; A63B 53/04

(52) U.S. Cl. ..... 228/215; 228/256; 473/324

(58) Field of Search ..... 228/214, 256, 228/261, 175, 215; 473/324–350

(56) References Cited

U.S. PATENT DOCUMENTS 4,252,262 A * 2/1981 Igarashi
4,768,787 A * 9/1988 Shira
5,272,802 A * 12/1993 Stites, III
5,299,807 A * 4/1994 Hutin
5,316,298 A * 5/1994 Hutin et al.
5,417,419 A * 5/1995 Anderson et al.
5,669,825 A * 9/1997 Shira
5,769,735 A * 6/1998 Hosokawa
5,800,285 A * 9/1998 Thorne et al.
5,871,408 A * 2/1999 Chen
6,056,649 A * 5/2000 Imai
6,089,992 A * 7/2000 Onumi et al.
6,099,414 A * 8/2000 Kusano et al.
6,193,614 B1 * 2/2001 Sasamoto et al.
6,209,777 B1 * 4/2001 Tung et al.

FOREIGN PATENT DOCUMENTS

JP 405076626 A * 3/1993
JP 410127831 A * 5/1998
JP 411057082 A * 3/1999
JP 02000202076 A * 7/2000
JP 02000233034 A * 8/2000

* cited by examiner

*Primary Examiner*—Tom Dunn
*Assistant Examiner*—Kiley Stoner
(74) *Attorney, Agent, or Firm*—Finnegan, Henderson, Farabow, Garrett & Dunner, L.L.P.

(57) ABSTRACT

Disclosed is a method of manufacturing a golf club head in which in integrating a metal plate part with a club head main body, either a fused metal or a fused ceramic is adhered onto a surface of the metal plate part before the metal plate part is welded to the club head main body, and the metal plate part is then welded to the club head main body thus integrating the metal plate part with the club head main body.

8 Claims, 5 Drawing Sheets

METHOD OF PRODUCING GOLF CLUB HEADS

BACKGROUND OF THE INVENTION

The present invention relates to a method of manufacturing a golf club head, and more particularly to a method of effectively manufacturing a golf club head, which has a fusion adhesive layer made of either a metal or a ceramic.

Conventionally, there has been a method of manufacturing a golf club head by welding a plate part such as a sole plate or a face plate onto a main body of the club head which has a crown part. In order to lower the center of gravity and improve wear resistance in such a golf club head, lamination of a heavy metal or a wear resistant metal onto the plate part is performed. As the lamination means, there are methods using clad materials, or machining processes such as pressing, caulking and bolting. Moreover, as a lamination method which is excellent in adhesion and workability, a method has been known, in which after the club head is assembled by welding, the above-mentioned metal material is sprayed onto a surface of the plate part and a thermal spraying layer is formed.

In this method, however, since the metal material is sprayed onto the club head taking a complicated stereoscopic shape with many curved planes, it is necessary to fix the club head so as to assume a posture for facilitating the spraying, or to mask the curved planes except a sole part and a face part in order to prevent the curved planes from being sprayed. Therefore, since the spraying work required much labor, a production efficiency was very low, and it was pointed out that the spraying efficiency was significantly bad due to a large quantity of a spraying material wasted.

SUMMARY OF THE INVENTION

The object of the present invention is to provide a method of manufacturing a golf club head having a fusion adhesive layer made of either a metal or a ceramic effectively, in which the golf club is manufactured by welding a metal plate part onto a main body of the club head.

Another object of the present invention is to provide a method of manufacturing a golf club head having the center of gravity lowered with a low cost.

Still another object of the present invention is to provide a method of manufacturing a golf club head which is not prone to be worn away and scratched.

In order to solve these problems, a method of manufacturing a golf club head of the present invention, in which a metal plate part is integrated with a golf club head main body by welding, comprises the steps of: adhering either a fused metal or a fused ceramic onto a surface of the plate part before the plate part is welded to the golf club head body; and welding the plate part to the golf club head body, thereby integrating the plate part to the golf club head body.

According to the present invention, as described above, either the fused metal or the fused ceramic is adhered onto the surface of the plate part before the plate part is welded to the golf club head body. The plate part is substantially flat and stable when it was placed on a plane. The plate part has a simple shape. Accordingly, since it is possible to adhere either the fused metal or the fused ceramic onto the surface of the plate part in a state that a lot of plate parts are arranged on a plane at a time, productivity can be improved. In addition, since the plate part can be easily fixed to the plane, a fusion adhered layer with a high dimensional accuracy can be formed, which is free from unevenness in the thickness Furthermore, wastage of either the metal material or the ceramic material can be reduced.

Here, "fusion adhesions" may be, for example, performed by thermal spraying. Thermal spraying is performed in such a manner that either metal or ceramic is melted, and the obtained melted substance is to spray onto a surface of the plate part from a nozzle.

BRIEF DESCRIPTION OF THE DRAWINGS

For a more complete understanding of the present invention and the advantages thereof, reference is now made to the following description taken in conjunction with the accompanying drawings.

FIG. 1(*b*) is a sectional view taken along the line A—A in FIG. 1(*a*).

FIG. 2(*b*) is a sectional view taken along the line B—B in FIG. 2(*a*).

FIG. 6(*b*) is a sectional view taken along the line C—C in FIG. 6(*a*).

DETAILED DESCRIPTION OF THE PREFERRED EMBODIMENTS

A manufacturing method of the present invention will be described with reference to the accompanying drawings.

Figure 1A:
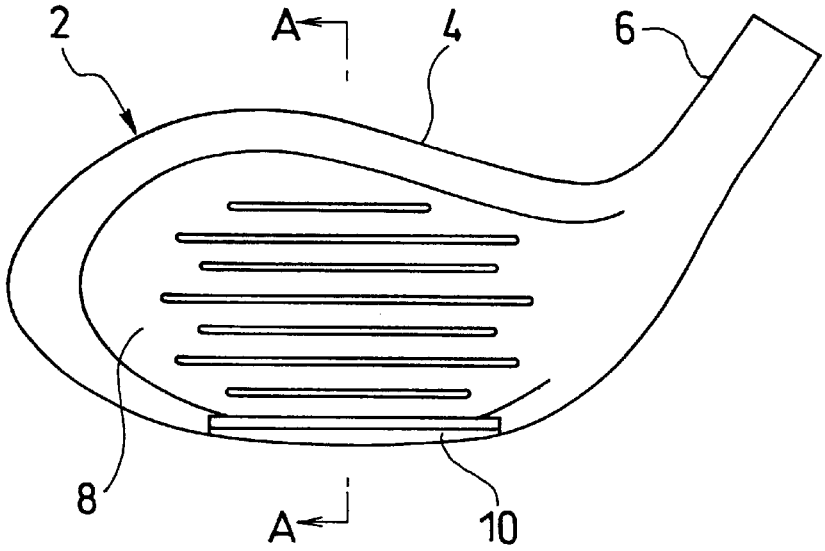
FIG. 1(*a*) is a front view showing an example of a club head main body before welding, which is to be used in the present invention.
Figure 1B:
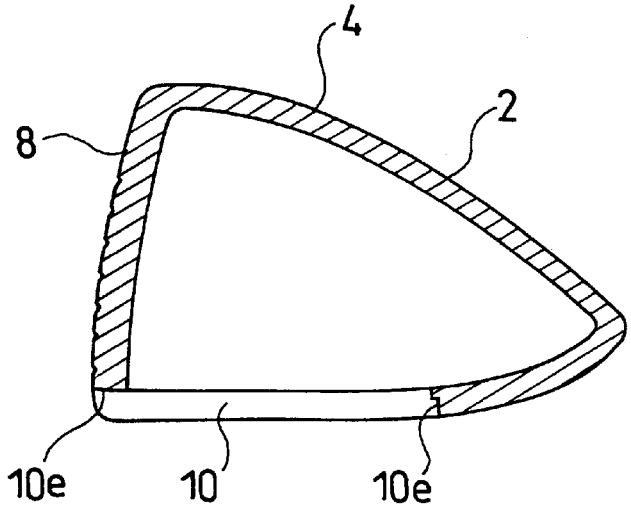

In the first place, a club head main body which is a wood-type golf club shown in. FIGS. 1(*a*) and 1(*b*) is prepared as an intermediate part, and a sole plate as shown in FIGS. 2(*a*) and 2(*b*) is prepared as a metal plate part.

In FIGS. 1(*a*) and 1(B), the club head main body 2 has a hollow space therein, and comprises a crown part 4, a hosel part 6 and a face part 8. An opening part 10 having an approximately quadrangular shape is provided at a position corresponding to the sole part. The club head main body 2 having such a shape manufactured by forging or casting from titanium or titanium alloy.

Figure 2A:
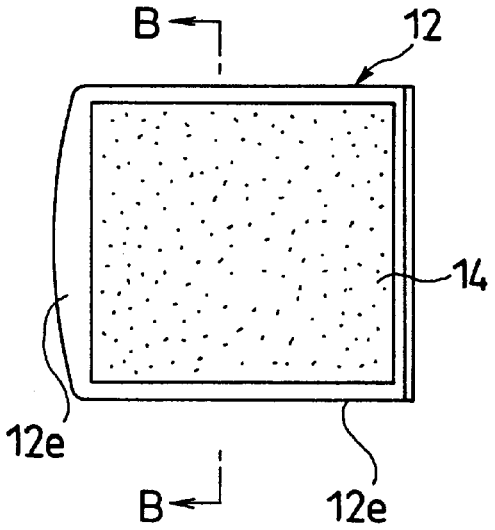
FIG. 2(*a*) is a plan view showing an example of a sole plate before welding, which is to be used in the present invention.
Figure 2B:
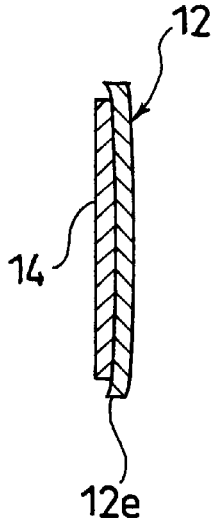

In FIGS. 2(*a*) and 2(*b*), the sole plate 12 has a shape corresponding to the opening part 10 of the club head main body 2. The sole plate 12 is made of the same materials as that of the club head main body 2, and is manufactured by forging or casting from titanium or titanium alloy. As a weight, a thermal spraying layer 14 made of either heavy metal such as tungsten, stainless steel, nickel alloy, copper, brass, zinc and iron, or ceramic is formed onto the surface of the sole plate 12 manufactured in the above described manner.

Figure 3:
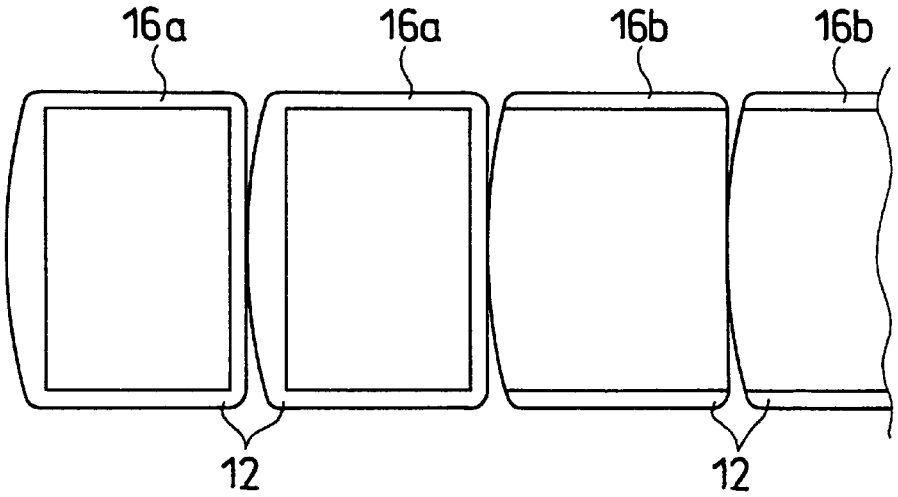
FIG. 3 is an explanatory view of a thermal spraying process of a sole plate in a manufacturing method of the present invention.

As the method of forming the thermal spraying layer 14, although the thermal spraying may be performed for one piece of the sole plate 12 so as to form a metal layer or a ceramic layer on the surface of the sole plate 12, shown in the FIG. 3, it is better to arrange the plurality of sole plates 12 in rows on a flat plane so as to be close each other, and to allow a thermal spraying, nozzle (not shown) to move along the rows, thus performing the spraying on the plurality of sole plates 12 simultaneously. In performing the thermal spraying, it is also better to adhere an edge part of the sole plates 12 with masking members 16*a* and 16*b* so as not to form a thermal spraying layer 14 in a sprayed margin to be welded to the club head main body 2. FIG. 3 shows a case when masking is performed by adhering the masking member 16*a* onto all sides of the sole plate 12, and a case when the masking is performed by adhering the masking member 16 onto only two sides of the sole plate 12.

Figure 4:
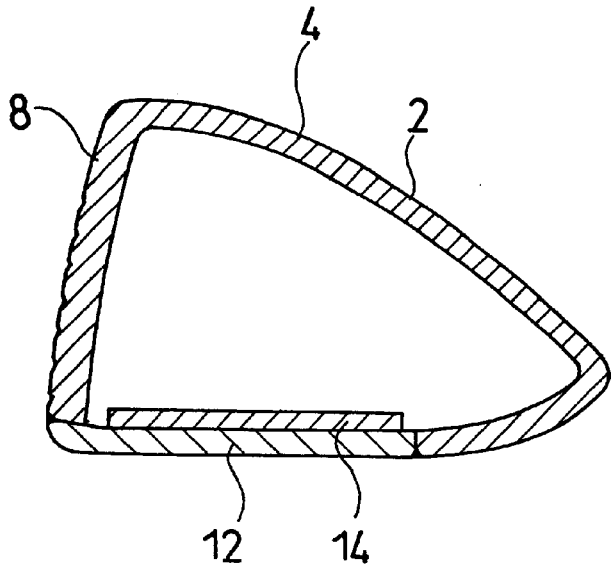
FIG. 4 is a sectional view corresponding to FIG. 1(*b*) taken along the line A—A in FIG. 1(*a*) manufactured by the present invention.

In the manufacturing method of the present invention, the sole plate 12 which has been prepared is fitted into the opening part 10 of the club head main body 2, then welding is performed along all portions of the surface of the opening part 10, thereby integrating both of them with each other. Thus, the golf club head as shown in FIG. 4 is completed. The welding to the sole plate 12 masked by the masking members 16*a* and 16*b* is performed in such a manner that after these masking members 16*a* and 16*b* are removed so as to expose an edge part 12*e,* this edge part 12*e* is contacted with an edge part 10*e* of the opening part 10 in the club head main body 2.

As described above, after the thermal spraying layer 14 is previously formed on the surface of the sole plate 12 in a state that is a single unit before being welded to the club head main body 2, the sole plate 12 is welded to the club head main body 2, completing the golf club head. Since many sole plates 12 are stably arranged on a plane at a time, it is possible to manufacture the golf club head with high production efficiency. In addition, unlike other solid club heads having an unstable shape for placing on a plane, since the sole plate 12 can be fixed in a stable condition on a plane, the thermal spraying layer 14 with high dimensional accuracy without unevenness in the thickness can be obtained and wastage of spraying materials such as heavy metals and the like can be reduced.

Figure 5:
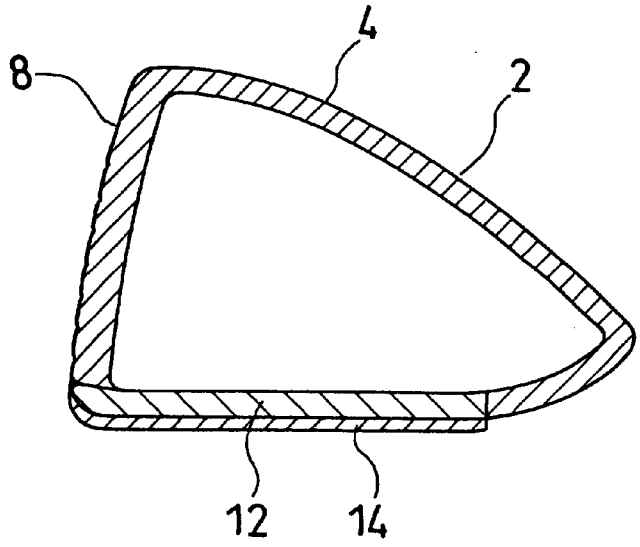
FIG. 5 is a sectional view taken along the line A—A in FIG. 10(*a*) and is corresponding to FIG. 1(*b*) produced by the present invention.

In the embodiment shown in FIG. 4, the thermal spraying layer 14 is formed on the inner surface of the sole plate 12 which is disposed inside of the club head main body 12 when the sole plate 12 is fitted to the club head main body 2. However, as shown in FIG. 5, the thermal spraying layer 12 may be formed on the outer surface of the sole plate 12. For the thermal spraying material in this case, besides heavy metals as a weight, super hard metals with wear resistance, a metal such as thermet, ceramic and the like are can be used. As shown in FIG. 4, when the thermal spraying layer 14 is formed on the inner surface of the sole plate 12, an appearance of the club head main body 2 becomes neat as compared with the case in FIG. 5 where the thermal spraying layer 14 is formed on the outer surface of the sole plate 12. Moreover, there is no problem even if the thermal spraying layer 14 has a low corrosion resistance. Therefore, as shown in FIG. 4, the thermal spraying layer 14 should be formed on the inner surface of the sole plate 12.

Figure 6A:
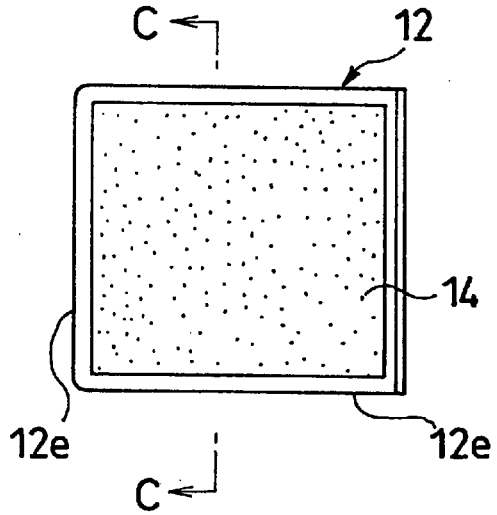
FIG. 6(*a*) is a plan view showing another example of a sole plate before welding, which is to be used in the manufacturing methods of the present invention.
Figure 6B:
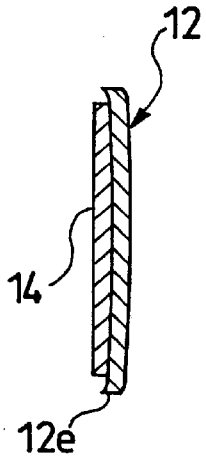
Figure 7:
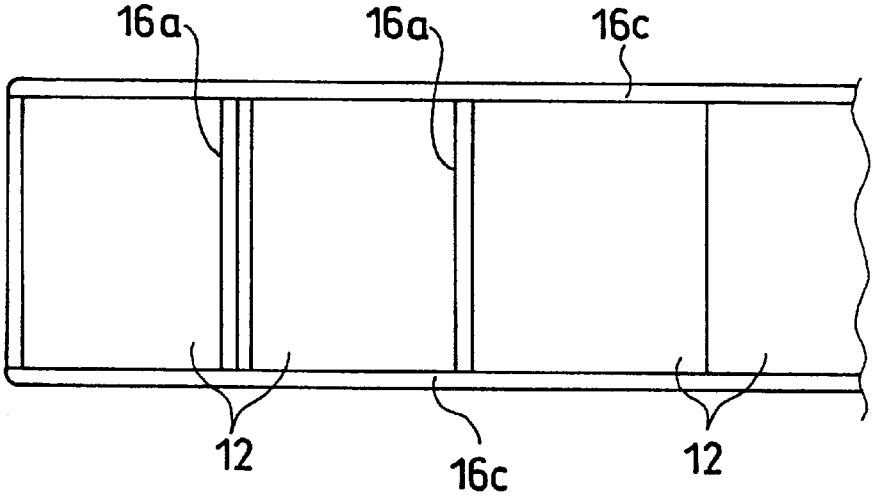
FIG. 7 is an explanatory view describing a thermal spraying process of a sole plate relating to FIG. 6(*a*) and FIG. 6(*b*).

In the embodiments shown in FIG. 4 and FIG. 5, although one side of the sole plate 12 is formed in accordance with the shape of the face part 8, the opening part 10 is formed only on the bottom surface side of the club head main body 2, and the sole plate 12 may be manufactured to a quadrangle shape with four straight line-shaped sides as shown in FIG. 6(*a*) and FIG. 6(*b*) so as to fit to the opening part 10. In this case, the thermal spraying layer 14 can be formed in the same manner as described above. However, as shown in FIG. 7, when the plurality of sole pates 12 are arranged and the thermal spraying treatment is performed as shown in FIG. 7, the gaps between each of the sole plates 12 are removed, thus further reducing the wastage of the spraying materials. Moreover, using the long length-masking member 16*c* for masking many sole plates 12 at a time, working efficiency at the spraying can be also improved.

Figure 8:
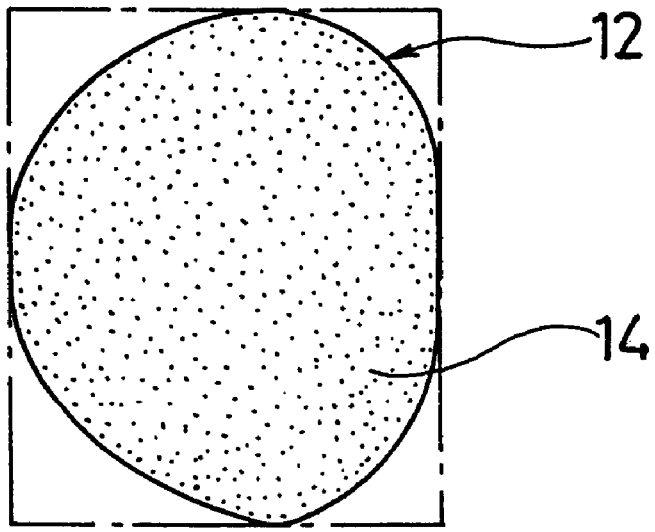
FIG. 8 is a plan view showing the other example of a sole plate before being welded, which is to be used in the manufacturing method of the present invention.

Although the sole plate 12 is preferably in a quadrangle shape when viewed from the upside as shown in FIG. 6(*a*) and FIG. 6(*b*), the sole plate 12 may be a polygon like a pentagon, a hexagon and the like when viewed from the upside. However, as shown in FIG. 8, the sole plate 12 having a shape with a curved circumference as shown in the FIG. 8 when viewed from the upside is not desirable because of production of wastage of the thermal spraying materials by leaking of the thermal spraying material up to the extent indicated by alternate long and short dash lines (effective percentage of the thermal spraying is about 70%). Contrary to this, a sole plate having a quadrangle shape when viewed from the upside hardly produces wastage of the thermal spraying material (effective percentage of the thermal spraying is nearly 100%).

Furthermore, in the foregoing embodiments, the case in which the sole plate part made of a metal constitutes the sole plate was described. The thermal spraying layer 14 can be formed on the face part of the gold club heads similarly to the above. For example, a crown part, a hosel part and a sole part are integrated to each other so as to form an integrated unit, thus constructing a club head main body. At this time, a face plate is in a state that it is not integrated with them. Then, the thermal-spraying layer 14 formed by thermally spraying a wear resistant substance such as ceramics is formed on the surface of the face plate, which is not integrated with the crown part, the hosel part and the sole part. The face plate is welded to the club head main body, thus completing the golf club head. The golf club heads can be also manufactured in such a manner with high production efficiency, as is the case in the foregoing embodiments.

Moreover, although the above description was made for the embodiments in the case of a wood-type golf club, the present invention is not limited to this case, it can be applied to other types of golf club heads such as a hollow or solid iron golf club head.

The present invention is directed to the case in which the club head main body and the plate part are manufactured by using metals which can be welded, and effects of the present invention are particularly exhibited in the case where titanium or titanium alloy are used.

Furthermore, as the metal and the ceramic which are sprayed in the present invention, heavy metals, metals with wear resistance, ceramics and the like, which have been conventionally sprayed for the purpose of affording a center of gravity lowered or wear resistance to the golf club head, can also be used. As the heavy metals, tungsten, stainless steel, nickel chrome alloy, copper, brass, zinc, iron and others can be mentioned, and one of them can be selectively used, or two or more of them can be selectively used.

As described above in detail, according to the present invention, either metal or ceramic is adhered in its fused state onto the surface of the plate part before the plate part is welded to the club head main body, and then the plate part is welded onto the club head main body, thus completing the golf club head. Accordingly, manufacturing of the golf club head having the fusion adhesive layer made of either metal or ceramic can be facilitated, and it is possible to manufacture the golf club heads with high production efficiency and high thermal spraying efficiency.

Although the preferred embodiment of the present invention has been described in detail, it should be understood that various changes, substitutions and alternations can be made therein without departing from spirit and scope of the inventions as defined by the appended claims.

What is claimed is:

1. A method of manufacturing a golf club head in which a metal sole plate is integrated with a club head main body by welding, comprising the steps of:

first adhering either a fused metal or a fused ceramic onto a portion of a surface of said metal sole plate, leaving at least another portion of said surface free of the fused metal or the fused ceramic; and then welding said metal sole plate at the portion of said surface that is free of the fused metal or the fused ceramic to said club head main body.

2. The method of manufacturing a golf club head according to claim 1, wherein said metal sole plate takes a polygonal shape when viewed from above.

3. The method of manufacturing a golf club head according to claim 2, wherein said polygonal shape is a quadrangle.

4. The method of manufacturing a golf club head according to claim 1, wherein a surface of said metal sole plate is first partially masked, and then either the fused metal or the fused ceramic is adhered onto the surface of said metal sole plate.

5. The method of manufacturing a golf club head according to claim 1, wherein said fused metal to be adhered is a heavy metal selected from at least one of tungsten, stainless steel, nickel alloy, copper, brass, zinc and iron.

6. The method of manufacturing a golf club head according to claim 1, wherein either said fused metal or said fused ceramic is adhered onto either an outer surface or an inner surface of said sole plate.

7. The method of manufacturing a golf club head according to claim 1, wherein said fused metal and said fused ceramic are adhered by a thermal spraying.

8. The method of manufacturing a golf club head according to claim 7, wherein a plurality of metal sole plates are arranged in rows on a flat plane so as to be close to each other, and a spraying nozzle is moved along the rows, thereby spraying either fused metal or fused ceramic onto the plurality of metal sole plates in a single spraying operation.

* * * * *